United States Patent [19]

Davis

[11] 4,126,114

[45] Nov. 21, 1978

[54] TEMPERATURE SENSOR VALVE

[76] Inventor: Bill G. Davis, 516 W. Rancho, Phoenix, Ariz. 85013

[21] Appl. No.: 783,563

[22] Filed: Apr. 1, 1977

[51] Int. Cl.[2] ..... F02B 77/00

[52] U.S. Cl. ..... 123/198 D; 123/41.15

[58] Field of Search ..... 123/41.15, 198 D, 198 DB, 123/198 DC; 236/98; 180/82 R, 103 R

[56] References Cited

U.S. PATENT DOCUMENTS

| | | | |
|---|---|---|---|
| 1,300,717 | 4/1919 | Fulton | 236/98 |
| 3,153,403 | 10/1964 | Dobbs | 123/41.15 |
| 3,202,143 | 8/1965 | Goodwin | 123/41.15 X |
| 3,533,391 | 10/1970 | Lockmuller | 123/41.15 X |
| 3,590,798 | 7/1971 | Goodwin | 123/41.15 X |
| 3,680,533 | 8/1972 | Sobershi | 123/41.15 X |
| 3,763,836 | 10/1973 | Guehr | 123/41.15 |
| 3,832,982 | 9/1974 | Guehr | 123/41.15 |

*Primary Examiner*—Ira S. Lazarus
*Attorney, Agent, or Firm*—Cahill, Sutton & Thomas

[57] ABSTRACT

In a liquid cooled engine or engine-driven accessory having an engine protection device for reducing the engine RPM to a safe level in response to a fluid pressure below an acceptable level, a temperature sensor valve continuously senses the operating temperature of the engine or engine-driven accessory and reduces the fluid pressure below the acceptable level of the engine protection device in response to an over-temperature condition or in response to a partial or complete loss of the liquid coolant.

The temperature sensor valve includes a temperature sensing tip which is coupled to the housing of the engine or engine-driven accessory. A heat receiving section of the temperature sensing tip receives heat from the housing and a heat dissipating section which protrudes into the coolant filled chamber transfers heat received from the heat receiving section into the coolant. The temperature sensing tip further includes an internal, longitudinally extending receptacle filled with a temperature responsive material which expands and contracts in response to the temperature of the temperature sensing tip. A partial or complete loss of coolant or an over-temperature condition will cause the temperature responsive material to expand and open a path in the temperature sensor valve which reduces the fluid pressure sensed by the engine protection device below the acceptable level and actuates the engine protection device to reduce the engine RPM to a safe level.

16 Claims, 6 Drawing Figures

1ST POSITION (SAFE)

2ND POSITION (UNSAFE)

TEMPERATURE SENSOR VALVE

BACKGROUND OF THE INVENTION

1. Field of the Invention

This invention relates to valves, and more particularly, to temperature sensor valves in an engine or engine-driven accessory for altering the pressure of a fluid in response to at least a partial loss of coolant or an over-temperature condition.

2. Description of the Prior Art

In the operation of internal combustion engines it is frequently desirable to provide protection means for automatically shutting off the engine or at least reducing its operating RPM to a safe level when certain conditions occur which would be detrimental to the engine or to an engine-driven accessory, such as an air compressor, hydraulic pump or transmission. To provide such protection, devices have been designed which are responsive to the temperature of the engine or accessory coolant. When the temperature of the coolant exceeds a predetermined value, these devices actuate an engine engine protection device such as a fuel shut-off valve which shuts off the fuel supply to the engine. A device of this type is disclosed in a patent issued to Goodwin (U.S. Pat. No. 3,302,143). However, devices such as these sense only the temperature of the engine coolant, whereas engine damage can occur when engine coolant is lost. Upon loss of engine coolant, the Goodwin apparatus will be ineffective since it will sense a low temperature because the coolant is no longer in contact with its temperature sensing probe. To protect an engine from damage due to loss of coolant a separate coolant level sensor must be provided to operate in conjunction with the Goodwin device to prevent damage due to an engine over-temperature condition resulting from loss of engine coolant. The requirement for a separate coolant temperature sensor and a coolant level sensor substantially increases the cost of installation of these devices since each device must be separately installed on the engine and coupled to a separate engine protection means for shutting down the engine when a loss of coolant occurs or when an engine over-temperature condition exists.

Other types of engine protection devices for preventing damage due to an engine over-temperature condition are disclosed in the following U.S. Pat. Nos. 3,153,403 (Dobbs), 2,125,066 (Cox), 1,869,429 (King), 1,838,409 (King).

SUMMARY OF THE INVENTION

It is therefore a primary object of the present invention to provide a temperature sensor valve which will actuate an engine protection means to reduce the engine RPM to a safe level when the temperature of the engine block exceeds a predetermined threshold level or when coolant is lost from the engine.

Another object of the present invention is to provide a temperature sensor valve which will activate an engine protection means to reduce the engine RPM to a safe level when the temperature of an engine-driven accessory exceeds a predetermined level or when the engine-driven accessory loses a portion of its coolant.

Yet another object of the present invention is to provide a temperature sensor valve which is heated by direct contact with the housing of an engine or engine-driven accessory and cooled by the coolant of the engine or engine-driven accessory in order to maintain the temperature of the temperature sensor valve at a predetermined level when the temperature of the engine lies within the normal operating range and when the engine coolant level is maintained at its normal capacity.

Still another object of the present invention is to provide a temperature sensor valve which is completely self-contained and mechanically actuated.

Yet another object of the present invention is to provide a temperature sensor valve which has a single moving part.

A still further object of the present invention is to provide a temperature sensor valve which is readily installed in an existing engine.

A yet further object of the present invention is to provide a temperature sensor valve which has a near zero failure rate.

Briefly stated, and in accord with one embodiment of the invention, a liquid cooled engine or engine-driven accessory includes engine protection means for reducing the engine RPM to a safe level in response to a fluid pressure below an acceptable level. A temperature sensor valve continuously senses the operating temperature of the engine or engine-driven accessory and reduces the fluid pressure below the acceptable level in response to an over-temperature condition or in response to at least a partial loss of liquid coolant. The main structural element of the temperature sensor valve is a body having a cylindrical bore. A first radially inwardly extending annular seat divides the bore into first and second sections. A fluid pressure port communicates with the first bore section which is connected to a source of fluid under pressure, while a fluid outlet port communicates with another portion the first bore section for providing a low pressure fluid drain path. Temperature sensor means is coupled to the housing of the engine or engine-driven accessory and protrudes into a coolant filled chamber of the engine or engine-driven accessory to receive heat from the housing and to transfer that heat into the coolant. The temperature sensor means includes a temperature sensing tip having an internal, longitudinally extending receptacle. A temperature responsive material is disposed within the receptacle for expanding and contracting in response to the temperature of the temperature sensing tip.

A piston is slidably movable in the bore between a first position and a second position. The piston includes a large diameter element having a first face positioned in the first bore section and communicating with the fluid pressure port. The piston further includes a small diameter element having a second face positioned in the second bore section and mechanically communicating with the temperature responsive material.

A cylindrical passageway defines an internal, longitudinally extending channel within the piston. This passageway has a first opening communicating with the first bore section for receiving the fluid under pressure and a second opening communicating with the second bore section. Sealing means is positioned around the periphery of the small diameter element of the piston between the second opening of the passageway and the large diameter element of the piston for blocking the flow of fluid from the fluid pressure port through the passageway to the fluid outlet port when the piston is in the first position. When the piston is in the second position, the sealing means is positioned such that a path is opened from the fluid pressure port through the passageway to the fluid outlet port. Biasing means exerts a predetermined force on the first face of the piston to urge the piston into the first position when the temperature sensed by the temperature sensor means lies within the normal operating temperature range and a normal level of liquid coolant is present.

An over-temperature condition or loss of liquid coolant causes the temperature responsive material to expand and displace the piston from the first position to the second position for reducing the fluid pressure by opening the path between the fluid pressure port and the fluid outlet port. Opening this path reduces the fluid pressure below the acceptable level of the engine protection means and thereby actuates the engine protection means to reduce the engine RPM to a safe level.

DESCRIPTION OF THE DRAWING

The invention is pointed out with particularity in the appended claims. However, other objects and advantages, together with the operation of the invention, may be better understood by reference to the following detailed description taken in connection with the following illustrations wherein:

DESCRIPTION OF THE PREFERRED EMBODIMENT

In order to better illustrate the advantages of the invention and its contributions to the art, a preferred hardware embodiment of the invention will now be described in some detail.

Figure 1:
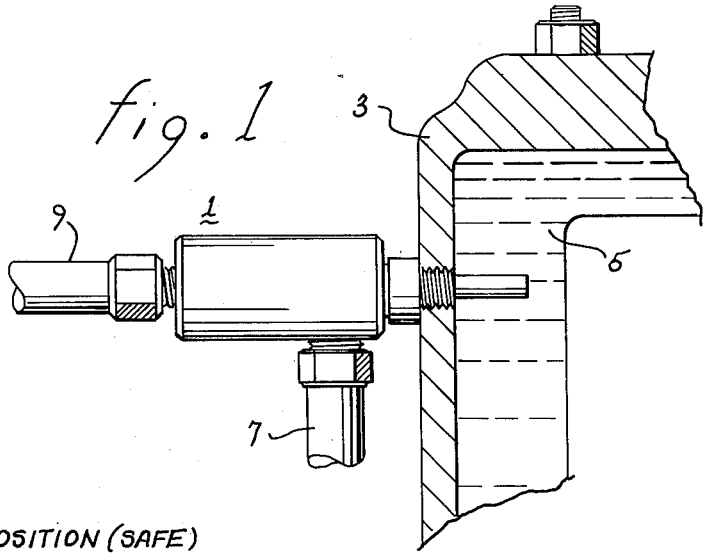
FIG. 1 is a side elevation view partially in section of the temperature sensor valve of the present invention installed in the block of an internal combustion engine and extending into a coolant filled chamber of the engine.

Referring to FIG. 1, temperature sensor valve 1 is coupled to the block 3 or some other integral metallic part of an internal combustion engine. A portion of temperature sensor valve 1 protrudes into a coolant filled chamber 5 of the internal combustion engine. Coolant filled chamber 5 could be the engine thermostat housing, the coolant jacket or the coolant manifold. The metallic part to which temperature sensor valve 1 is attached cannot be separated from the main body of the engine by a hose or other heat insulator; it must be attached to a metalic portion of the engine where it can receive heat directly transmitted from the engine cylinder head, which is the primary source of engine heat. Oil pressure line 7 transmits oil under pressure from the internal combustion engine oil system to temperature sensor valve 1. Oil return line 9 provides a low pressure oil return path to the crankcase of the engine to drain the oil released by temperature sensor valve 1 when an unsafe temperature or coolant condition exists. Oil pressure line 7 is typically connected to the oil pressure inlet port of an engine protection means such as that described in my copending U.S. patent application entitled "FUEL SHUT-OFF VALVE," Ser. No. 680,576.

An engine over-temperature condition or a partial or complete coolant loss will activate temperature sensor valve 1 to open a path between oil pressure line 7 and oil return line 9, thus decreasing the oil pressure sensed by the engine protection means, which can either reduce the engine operating RPM to idle or totally shut off the engine.

Figure 2:
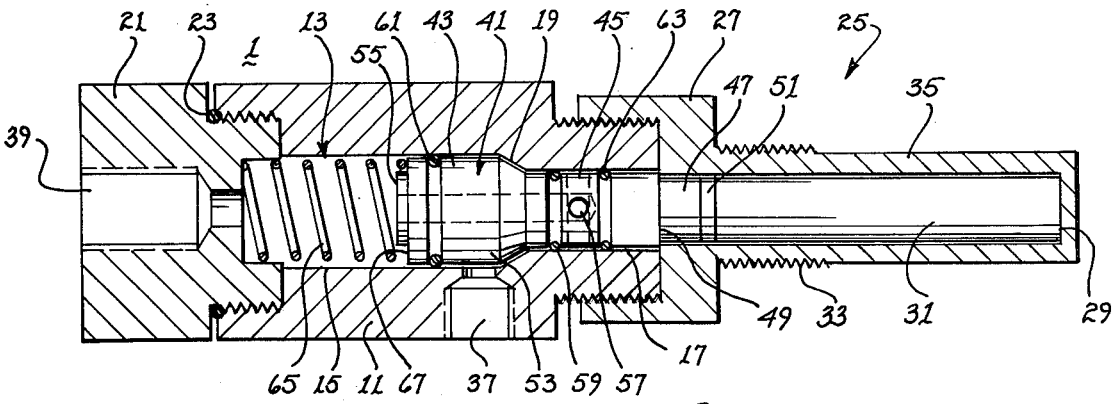
FIG. 2 is a sectional view of the temperature sensor valve of the present invention in the first position which corresponds to a safe temperature and coolant condition.

Referring now to FIG. 2, temperature sensor valve 1 includes a body 11 having a longitudinally extending cylindrical bore 13. Cylindrical bore 13 is divided into a first section 15 and a second section 17 by a radially inwardly extending annular seat 19. An end cap 21 is attached to body 11 to enclose the operational elements of temperature sensor valve 1. O-ring 23 provides a tight seal between end cap 21 and body 11.

Temperature sensor means 25 is rigidly attached to body 11 and includes a temperature sensing tip 27 having an internal, longitudinally extending receptacle 29 which encloses a temperature responsive material 31.

In the preferred embodiment temperature responsive material 31 is a medium density polyethylene rod manufactured and sold by Union Carbide under the trademark Polypenco and specifically designated as 6423 Black 9865 Resin. Polypenco rod 31 was selected because it is solid polyethylene material which can be readily ground and cut to length for precisely fitting within receptacle 29. Additionally, the Polypenco rod 31 expands at a very rapid rate between 185° and 235° F., while large temperature excursions above 235° F. and below 185° F. have little physical effect on the rod. While a temperature responsive material 31 such as a Polypenco rod has been found to be highly advantageous, it has also been found that other polyethylene materials or bee's wax also function satisfactorily.

Temperature sensing tip 27 is fabricated from brass and includes heat receiving means 33 which is threadably attached to engine block 3 for directly receiving heat from the engine and uniformly transmitting that heat along the length of temperature sensing tip 27. Temperature sensing tip 27 further includes heat dissipating means 35 which protrudes into coolant filled chamber 5 for transferring heat out of temperature sensing tip 27 into the liquid coolant in coolant filled chamber 5.

Oil pressure line 7 is coupled to fluid pressure port 37 for transmitting oil under pressure into first bore section 15. Oil return line 9 is coupled to fluid outlet port 39 to provide a low pressure oil return path to the engine crankcase.

A piston 41 includes a large diameter element 43 disposed within first bore section 15. A small diameter element 45 of piston 41 is disposed within second bore section 17 and is displaceable partially within first section 15. A brass spacer 47 is disposed within receptacle 29 between second face 49 and a teflon spacer 51 which is positioned adjacent to one end of temperature responsive material 31. Teflon spacer 51 provides a positive seal between the walls of receptacle 29 and temperature sensitive material 31 to prevent flow-by or flashing of temperature sensitive material 31 into second bore section 17 due to the elevated temperatures present in temperature sensor means 25 during normal engine operation.

Cylindrical passageway 53 defines an internal, longitudinally extending channel within piston 41 and includes a first opening 55 which communicates with first bore section 15. A second opening 57 in passageway 53 is disposed in the opposite end of passageway 53 for communicating with second bore section 17. Second opening 57 consists of four radially inwardly extending apertures drilled into piston 41 at 90° intervals around the periphery thereof.

Sealing means or O-ring 59 is positioned around the periphery of small diameter element 45 of piston 41 to prevent the flow of oil from fluid pressure port 37 through passageway 53 to fluid outlet port 39 when piston 41 is in the first position illustrated in FIG. 2. O-ring 61 is positioned around the periphery of large diameter element 43 of piston 41 to prevent the flow of oil around the periphery of piston 41 from first bore section 15 to oil outlet port 39. O-ring 63 is positioned around the outer periphery of small diameter element 45 of piston 41 to prevent the flow of oil past the periphery of piston 41 from second opening 57 in passageway 53 to receptacle 29.

A biasing means or spring 65 is positioned within first bore section 15 and passes against first face 67 of piston 41 to urge piston 41 into the first position.

FIG. 2 shows piston 41 of temperature sensor valve 1 in the first position which indicates three things:

1. The temperature of engine block 3 is below a predetermined maximum safe value;
2. The temperature of the coolant within coolant filled chamber 5 is below a predetermined maximum safe value; and
3. Heat dissipation means 35 is totally surrounded by liquid coolant in coolant filled chamber.

Figure 3:
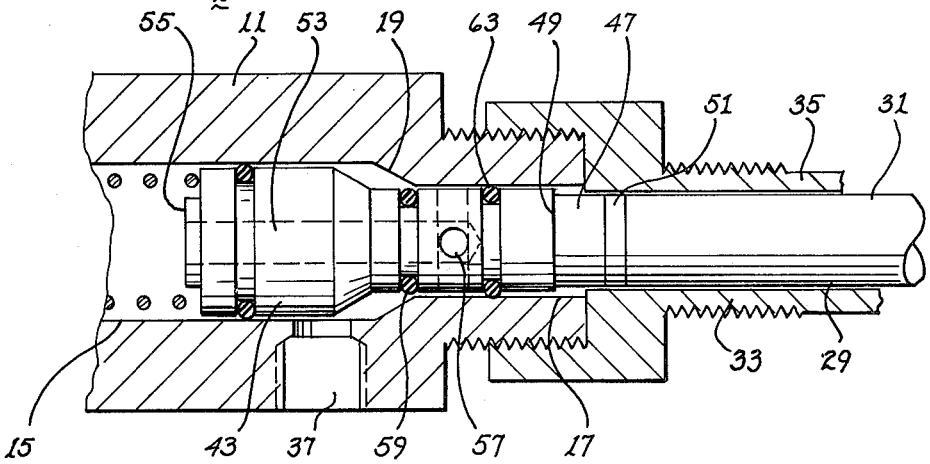
FIG. 3 is a sectional view, partially cut away, of the temperature sensor valve of the present invention in the second position corresponding to an unsafe temperature or coolant condition.

If temperature sensor valve 1 is designed to be installed in an engine having a 185° F. normal operating temperature and a 220° F. maximum permissable temperature, then piston 41 will be in the first position shown in FIG. 2 when the engine temperature is maintained at the 185° F. normal operating temperature. When the engine temperature exceeds 220° F., temperature responsive material 31 will have expanded within receptacle 29, and displaced teflon spacer 51, brass spacer 47, and piston 41 to the left into the second position or unsafe position as indicated in FIG. 3.

In the second position, sealing means 59 is no longer in sealing engagement with second bore section 17; sealing means 59 is now located in the area defined by annular seat 19. Oil under pressure within first bore section 15 can now flow through first opening 55, passageway 53 and second opening 57. The oil passes by sealing means 59 and is discharged through fluid outlet port 39. Since the path between fluid pressure port 37 and fluid outlet port 39 is open, the pressure in oil pressure line 7 will be diminished to a level below the threshold activation level of the engine protection means, such as a fuel shut-off valve. This reduced oil pressure will activate the engine protection means to either reduce the engine RPM to a safe level or to shut down the engine.

Since heat dissipating means 35 requires the presence of liquid coolant to transfer heat away from temperature sensing tip 27, the loss of a predetermined amount of liquid coolant will reduce the coolant level in coolant filled chamber 5 to a level below temperature sensing tip 27. When the coolant level falls to that point, heat dissipating means 35 will no longer dissipate heat from temperature sensing tip 27, so that the temperature of temperature sensing tip 27 will rapidly increase causing temperature responsive material 31 to expand and thereby displace piston 41 into the second position.

While temperature sensor valve 1 has been shown attached to the block of an engine, it is readily apparent that this apparatus can be used to sense the temperature and presence or absence of a liquid coolant in any engine-driven accessory, such as an air compressor, a transmission, or even the differential assembly of an engine drive train. Furthermore, it would be possible to use temperature sensor 1 in conjunction with a high volume engine driven water pump as might be included in a fire engine. Since this variety of water pump relies on the flow of water for cooling, the loss of a source of water for the pump would quickly activate temperature sensor valve 1 which is coupled to an engine protection means on the internal combustion engine which drives the water pump.

It is also possible to couple temperature sensor valve 1 to a source of pressurized fluid other than oil. It would be possible for temperature sensor valve 1 to decrease the pressure in a fluid system which would thereby activate a pressure sensitive switch which could disable an engine ignition system or shut off its source of fuel supply.

Furthermore, teflon spacer 51 of temperature sensor means 25 could be directly coupled to a switching means, such as a microswitch, for grounding out the ignition system of an engine when the temperature sensor senses either an over temperature condition or at least a partial loss of liquid coolant. In this embodiment the electrical switching means would replace the hydromechanical actuation system described above.

Figure 4:
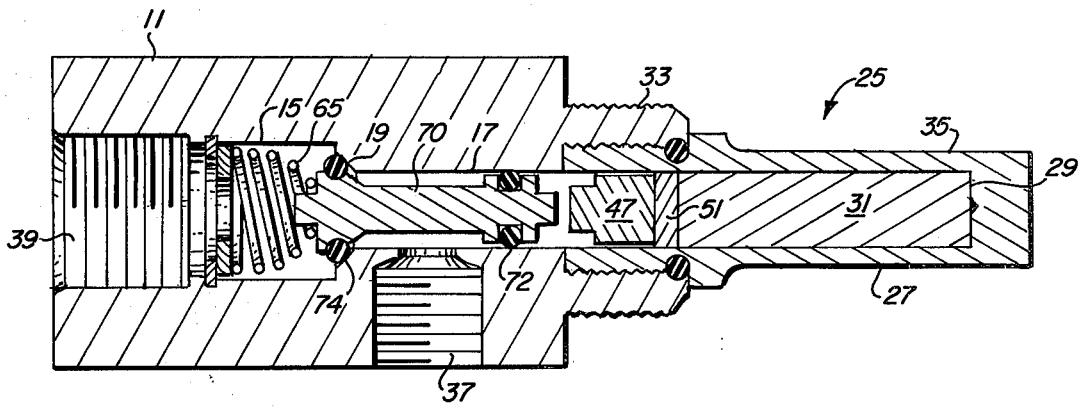
FIG. 4 is a sectional view of a second embodiment of the temperature sensor valve of the present invention in the first position.
Figure 5:
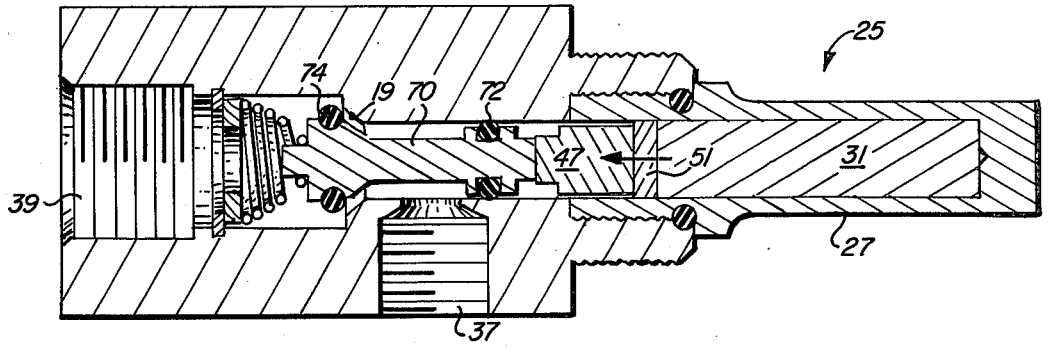
FIG. 5 is a sectional view of a second embodiment of the temperature sensor valve of the present invention in the second position.
Figure 6:
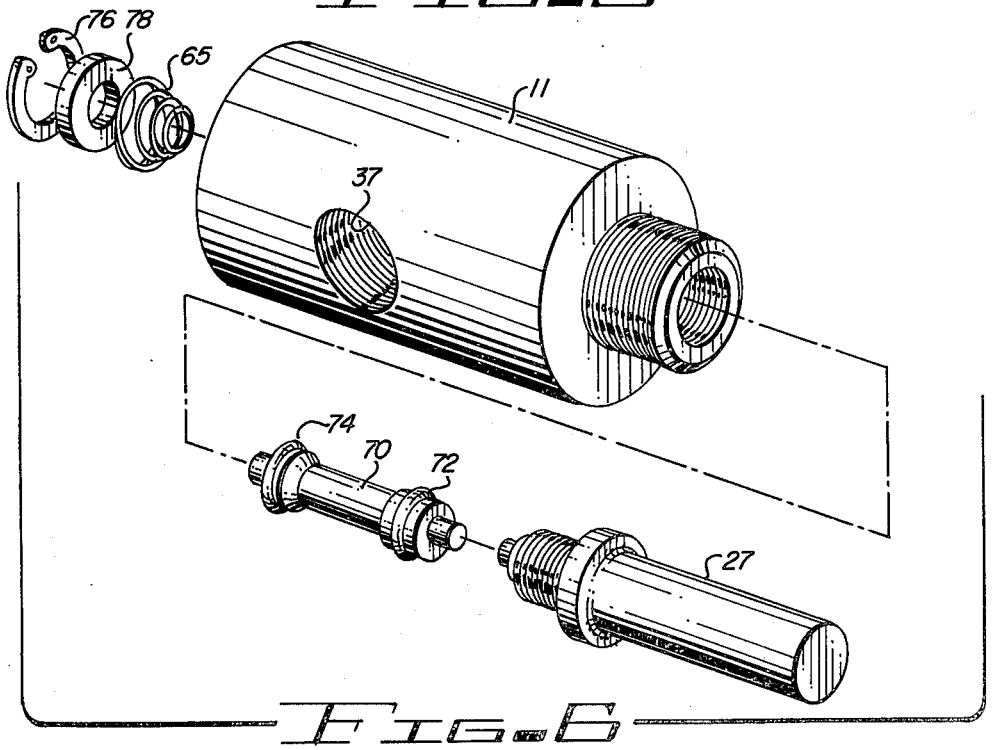
FIG. 6 is an exploded perspective view of the second embodiment of the temperature sensor valve.

Referring now to FIGS. 4, 5, and 6, a second functionally equivalent embodiment of the temperature sensor valve is shown. In this second embodiment piston 41 has been replaced by a simplified piston 70 which includes a relatively heat insensitive teflon O-ring 72 on one end and a heat resistant O-ring 74 on the oposite end. O-ring 72 is compounded to be compatible with petroleum products in a manner well known in the art.

A retaining ring 76 and a spring retainer 78 maintain spring 65 within first bore section 15. FIG. 4 illustrates the second embodiment of the temperature sensor valve in the first position. This position corresponds to a cool or normal operating temperature and indicates safe engine operation.

FIG. 5 illustrates the temperature sensor valve in the second or unsafe position wherein piston 70 has been displaced to the left by a loss of coolant or by an engine over temperature condition. A gap now exists between O-ring 74 and annular seat 19 which allows oil to pass between fluid pressure port 37 and fluid outlet port 39. The opening of this passageway reduces the engine oil pressure below an acceptable level which activates the engine protection means in a manner identical to that described above with respect to the first embodiment of the temperature sensor valve.

This second embodiment of the temperature sensor valve is advantageous as a result of its simplified mechanical structure which increases the reliability of operation and decreases the costs of fabrication.

The gap between the forward edge of piston 70 and spacer 47 as shown in FIG. 4 will normally decrease in size at normal operating temperatures. Piston 70 will not be displaced to the left until an unsafe engine operating condition occurs.

It will be apparent to those skilled in the art that the disclosed temperature sensor valve may be modified in numerous other ways and may assume many other embodiments other than the preferred forms specifically set out and described above. Accordingly, it is intended by the appended claims to cover all such modifications of the invention which fall within the true spirit and scope of the invention.

What is claimed is:

1. In a liquid cooled engine or engine-driven accessory having engine protection means for reducing the engine RPM to a safe level in response to a fluid pressure below an acceptable level, a temperature sensor valve for continuously sensing the operating temperature of the engine or engine-driven accessory and the presence or absence of liquid coolant, and for reducing the fluid pressure below the acceptable level in response to an over-temperature condition or in response to an over-temperature condition or in response to at least a partial loss of the liquid coolant, said temperature sensor valve comprising in combination:

(a) temperature sensor means coupled to the housing of said apparatus and protruding into a coolant filled chamber of the apparatus for receiving heat from the housing and for transferring heat into the coolant, said temperature sensor means including
  (i) heat rceiving means in mechanical contact with the housing for receiving heat from the housing;
  (ii) heat dissipating means extending into the collant filled chamber for transferring the heat received by said heat receiving means into the coolant;
  (iii) means defining a receptacle within said temperature sensor means;
  (iv) a temperature responsive material disposed within said receptacle for expanding and contracting in response to the temperature of said temperature sensor means; and (b) means in mechanical contact with said temperature responsive material for reducing said fluid pressure below said acceptable level to thereby reduce the RPM of said heat generating apparatus when said temperature responsive material expands beyond a predetermined volume.

2. The apparatus of claim 1 wherein said temperature sensor means includes:

(a) a temperature sensing tip having an internal, longitudinally extending receptacle.

3. In a liquid cooled engine or engine-driven accessory having engine protection means for reducing the engine RPM to a safe level in response to a fluid pressure below an acceptable level, a temperature sensor valve for continuously sensing the operating temperature of the engine or engine-driven accessory and the presence or absence of liquid coolant, and for reducing the fluid pressure below the acceptable level in response to an over-temperature condition or in response to at least a partial loss of the liquid coolant, said temperature sensor valve comprising in combination:

(a) a body having a cylindrical bore;

(b) a first radially inwardly extending annular seat dividing said bore into first and second sections;

(c) a fluid pressure port communicating with said first bore section for connection to a source of fluid under pressure;

(d) a fluid outlet port communicating with said first bore section for providing a low pressure fluid drain;

(e) temperature sensor means coupled to the housing of said engine or engine-driven accessory and protruding into a coolant-filling chamber of the engine or engine-driven accessory for receiving heat from the housing and for transferring heat into the coolant, said temperature sensor means including
  (i) a temperature sensing tip having an internal, longitudinally extending receptacle;
  (ii) a temperature responsive material disposed within said receptacle for expanding and contracting in response to the temperature of said temperature sensing tip;

(f) a piston slidably displaceable in said bore between a first position and a second position said piston including
  (i) a first face positioned in said first bore section and communicating with said fluid pressure port;
  (ii) a second face positioned in said second bore section and mechanically communicating with said temperature responsive material
  (iii) a cylindrical passageway defining an internal, longitudinally extending channel within said piston and having a first opening communicating with said first bore section for receiving the fluid under pressure and a second opening communicating with said second bore section;

(g) sealing means positioned around the periphery of said piston between said first and second bore sections for blocking the flow of fluid from said fluid pressure port through said passageway to said fluid outlet port when said piston is in the first position, and for opening a path from the fluid pressure port through said passageway to the fluid outlet port when said piston is in the second position; and (h) biasing means for exerting a predetermined force on said piston to urge said piston into the first position;

whereby an engine overtemperature condition or loss of a predetermined amount of liquid coolant causes said temperature responsive material to expand and displace said piston from the first position to the second position for opening the path between said fluid pressure port and said fluid outlet port for reducing the fluid pressure below the acceptable level and thereby actuating the engine protection means to reduce the engine RPM to a safe level.

4. The apparatus of claim 3 wherein said temperature sensor means further includes:

(a) heat receiving means coupled to the housing of said engine or engine-driven accessory for receiving heat therefrom; and (b) heat dissipating means in contact with the liquid coolant for transferring heat from said temperature sensor means into the liquid coolant.

5. The apparatus of claim 3 wherein said temperature sensing tip is fabricated form a heat conductive material.

6. The apparatus of claim 5 wherein said heat conductive material is brass.

7. The apparatus of claim 3 wherein said temperature sensitive material includes a polyethylene material.

8. The apparatus of claim 3 wherein said temperature sensitive material includes bee's wax.

9. The apparatus of claim 5 further including a spacer positioned between the second face of said piston and one end of said temperature responsive material.

10. In a liquid cooled engine or engine-driven accessory having engine protection means for reducing the engine RPM to a safe level in response to a fluid pressure below an acceptable level, a temperature sensor valve for continuously sensing the operating temperature of the engine or engine-driven accessory and the presence or absence of liquid coolant, the engine or engine-driven accessory including a housing and a coolant-filled chamber, and for reducing the fluid pressure below the acceptable level in response to an over-temperature condition or in response to at least a partial loss of the liquid coolant, said temperature sensor valve comprising in combination:

(a) a body having a cylindrical bore;

(b) a first radially inwardly extending annular seat dividing said bore into first and second sections;

(c) a fluid pressure port communicating with said first bore section for connection to a source of fluid under pressure;

(d) a fluid outlet port communicating with said second bore section for providing a low pressure fluid drain;

(e) temperature sensor means coupled to the housing and protruding into the coolant-filled chamber for receiving heat from the housing and for transferring heat into the coolant, said temperature sensor means including i. a temperature sensing tip having an internal, longitudinally extending receptacle;

ii. a temperature responsive material disposed within said receptacle for expanding and contracting in response to the temperature of said temperature sensing tip;

(f) a piston slidably displaceable in said bore between a first position and a second position said piston including i. a first face positioned in said first bore section and communicating with said fluid pressure port;

ii. a second face positioned in said second bore section and mechanically communicating with said temperature responsive material;

(g) sealing means positioned around the periphery of said piston between said first and second bore sections for blocking the flow of fluid from said fluid pressure port to said fluid outlet port when said piston is in the first position, and for opening a path from the fluid pressure port to the fluid outlet port when said piston is in the second position; and (h) biasing means for exerting a predetermined force on said piston to urge said piston into the first position;

whereby an engine overtemperature condition or loss of a predetermined amount of liquid coolant causes said temperature responsive material to expand and displace said piston from the first position to the second position for opening the path between said fluid pressure port and said fluid outlet port for reducing the fluid pressure below the acceptable level and thereby actuating the engine protection means to reduce the engine RPM to a safe level.

11. The apparatus of claim 10 wherein said temperature sensor means further includes:

(a) heat receiving means coupled to the housing of said engine or engine-driven accessory for receiving heat therefrom; and (b) heat dissipating means in contact with the liquid coolant for transferring heat from said temperature sensor means into the liquid coolant.

12. The apparatus of claim 10 wherein said temperature sensing tip is fabricated from a heat conductive material.

13. The apparatus of claim 12 wherein said heat conductive material is brass.

14. The apparatus of claim 10 wherein said temperature sensitive material includes a polyethylene material.

15. The apparatus of claim 10 wherein said temperature sensitive material includes bee's wax.

16. The apparatus of claim 12 further including a spacer positioned between the second face of said piston and one end of said temperature responsive material.

* * * * *